United States Patent [19]

Peter et al.

[11] Patent Number: 4,762,013

[45] Date of Patent: Aug. 9, 1988

[54] RECIPROCATING DEVICE FOR SPRAY COATING

[75] Inventors: Dirk A. Peter, Toledo; Timothy H. Drury, Howell, both of Mich.

[73] Assignee: The DeVilbiss Company, Toledo, Ohio

[21] Appl. No.: 893,673

[22] Filed: Aug. 6, 1986

[51] Int. Cl.[4] ..... B05B 3/18; B05B 13/04; B05B 15/08

[52] U.S. Cl. ..... 74/104; 74/89.21; 74/531; 118/315; 118/323; 239/243; 239/587; 239/752; 901/7; 901/43

[58] Field of Search ..... 74/50, 89.21, 104, 531, 74/479; 118/315, 323; 239/69, 243, 587, 752, 753; 403/362; 901/7, 43

[56] References Cited

U.S. PATENT DOCUMENTS

| | | | |
|---|---|---|---|
| 27,057 | 2/1860 | Lazelle | 74/50 |
| 2,559,225 | 7/1951 | Ransburg | 118/323 X |
| 3,219,276 | 11/1965 | Norris | 118/315 X |
| 3,274,860 | 9/1966 | Gauthier et al. | 118/323 X |
| 3,463,520 | 8/1969 | Turro | 403/362 |
| 3,606,162 | 9/1971 | Lehmann | 239/227 |
| 3,749,051 | 7/1973 | Sumner et al. | 118/323 X |
| 4,125,035 | 11/1978 | Dooley | 74/480 R |
| 4,345,491 | 8/1982 | Hannon | 74/831 |
| 4,349,182 | 9/1982 | Blackburn | 901/7 |
| 4,378,705 | 4/1983 | Oka | 74/37 |
| 4,404,870 | 9/1983 | Atumaru | 74/829 |
| 4,516,526 | 5/1985 | Drockila | 118/323 |
| 4,534,006 | 8/1985 | Minucciani et al. | 901/7 X |
| 4,538,546 | 9/1985 | Baron | 118/323 X |
| 4,593,360 | 6/1986 | Cocks | 364/468 |

*Primary Examiner*—Allan D. Herrmann

*Attorney, Agent, or Firm*—MacMillan, Sobanski & Todd

[57] ABSTRACT

A reciprocating device for spray painting an object includes a plurality of mounting arms each having one end releasably retaining a spray painting device and an opposite end releasably coupled to one of a pair of spaced apart generally parallel vertically extending posts. The posts are attached to a driving mechanism which includes a servomotor coupled to one end of a crank arm having its other end rotatably coupled to a sliding block engaging a generally horizontally extending rod to convert the rotary motion of the motor to vertical motion of the rod. The rod is coupled to the ends of the posts and the motor is controlled as to its direction of rotation, speed of rotation and degree of rotation to define the excursion of the reciprocating movement and the speed of the movement. The assembly is mounted on rails for movement toward and away from the object to be painted by another driving mechanism.

24 Claims, 5 Drawing Sheets

RECIPROCATING DEVICE FOR SPRAY COATING

BACKGROUND OF THE INVENTION

The invention relates generally to a device for moving a spray coating apparatus with respect to a workpiece and, in particular, to such a reciprocating device in which the speed and distance of movement can be adjusted.

In the prior art, a plurality of workpieces to be coated are typically moved by a conveyor past one or more spray guns for spraying the coating. The spray guns are either stationary or are mounted to swing up and down or to and fro, the deflection from the central point of the swinging movement usually being adjustable.

The best movement for the gun is usually dictated by the shape of the workpiece. A spraying apparatus for automatically coating workpieces having a complicated shape is disclosed in U.S. Pat. No. 3,606,162. In this patent, a spray gun is mounted on a carrier head for pivoting movement in a vertical plane. The carrier head is mounted on a lifting stand for vertical up and down movement and the lifting stand is placed on a carriage means for movement in a horizontal plane in two directions at right angles to each other. The movements of the spray gun, lifting stand, and carriage means are effected by motors controlled by programmed control devices adapted to be set to produce a sequence of operating steps of the spray gun, lifting stand, and carriage means. The motors are direct current motors which are controlled as to direction of rotation, speed, and running time.

U.S. Pat. No. 4,125,035 discloses a control mechanism for spray guns which includes a rectangular frame having crossing supporting rods extending between opposite frame members. A mounting member is slidably mounted on crossing portions of the rods and carries a spray gun which can be moved toward and away from the mounting member in a direction perpendicular to the plane of the frame. The spray guy can also be pivotally moved on a first axis which is parallel to the plane of the frame and pivotally moved on a second axis which can also be parallel to the frame and perpendicular to the first axis. The spray gun can also be pivotally moved about an axis which is perpendicular to one of the aforesaid axes.

In another form of reciprocating device, two vertically spaced apart sprocket wheels are joined by an endless chain and a pin fixed to the chain moves in a horizontally disposed slot in a support for a spraying device such that reciprocation of the reciprocating member is achieved by the movements of the chain. This device has a disadvantage since the reciprocating member must reciprocate over the full distance between the two sprocket wheels regardless of the size of the object to be painted.

U.S. Pat. No. 4,378,705 discloses a reciprocating device in which a reciprocating member alternately and selectively engages with either the upwardly moving side or the downwardly moving side of an endless member such as a chain or belt which is running in one direction. Thus, the range of reciprocating movement can be determined by the timing of the mechanism for alternately engaging the two sides of the chain.

U.S. Pat. No. 4,404,870 discloses a reciprocator for a paint gun which has a plurality of fixed pulleys and a plurality of moveable pulleys, the moveable pulleys being reciprocated upwardly and downwardly. A slider on which the paint gun is mounted is attached to one end of a wire which is threaded through the pulleys and fixed at the other end for moving the paint gun as the moveable pulleys are reciprocated.

In another form of prior art spraying device, a pair of spaced apart, generally vertically extending bars are pivotally attached to opposite ends of a pair of generally parallel spaced apart horizontally extending bars. One of the vertical bars is fixed with respect to a work piece to be coated and the other vertically extending bar has one or more spray painting devices attached to it. The lower one of the generally horizontally extending bars is pivotally attached to a crank arm between its ends which in turn is driven by a motor, thereby reciprocating the two horizontal bars and the one free vertical bar in an arcuate path. The excursion of the reciprocating motion can be adjusted by moving the attachment point of the crank arm to the lower horizontal bar. One disadvantage of this type of device is that the spray painting devices move in a arc rather than in a straight vertical path parallel to the work piece.

SUMMARY OF THE INVENTION

The present invention relates to a unique spray painting reciprocator which utilizes a reversible servomotor for alternately driving a slidable sled assembly on which spraying devices are mounted in opposite directions. As will be apparent below, the use of a reversible servomotor enables the stroke length of the reciprocator to be adjusted electrically by controlling the amount of rotation of the servomotor output shaft, and thus, does not require a separate mechanical adjustment as required by the prior art devices.

More specifically, the reciprocator of the present invention includes a pair of spaced apart generally parallel rails defining a generally horizontal path of travel with respect to a location in which an object is to be painted, and a frame mounted for travel on the rails and coupled to a first drive means for positioning the frame in a selected position. A pair of spaced apart generally parallel vertically extending posts are mounted on the frame and each has one or more generally horizontally extending arms for mounting spray painting devices thereon. The posts are adapted to house and protect a major portion of the hoses connected to the spraying device.

A second drive means is mounted on the frame and is coupled to the posts for reciprocating the posts and the arm in a generally vertical path, and a control unit is coupled to the second drive means for selectively determining the excursion of the posts and arms along the vertical path. The second drive means includes a reversible electric motor coupled to one end of a crank arm, a sliding block rotatably coupled to an opposite end of the crank arm, a generally horizontally extending rod slidably engaged in an aperture formed in the sliding block and coupled to the posts. Rotation of the crank arm by the motor in a generally vertically plane reciprocates the rod, the posts, and the arms along the vertical path. The control unit can be utilized to automatically vary the speed and the degree of rotation of the motor, thereby changing the speed of reciprocation and the total excursion. The motor is run in opposite directions of rotation to achieve the upward and downward movement, with the maximum excursion achieved by positions which are 180° apart in a vertical direction.

The present invention also includes adjustable means for determining the horizontal spacing between the spray devices and the object to be coated and also for determining the vertical spacing of the spray devices along the posts. A spring tension means is provided to adjustably compensate for the weight of a plurality of spray devices.

The present invention overcomes one of the advantages of most of the prior art systems in that the stroke length of the reciprocating motion could not be adjusted while the device was being operated. Furthermore, the present device also protects a major portion of the hoses connected to the spray painting devices and keeps them clean during the painting operation.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
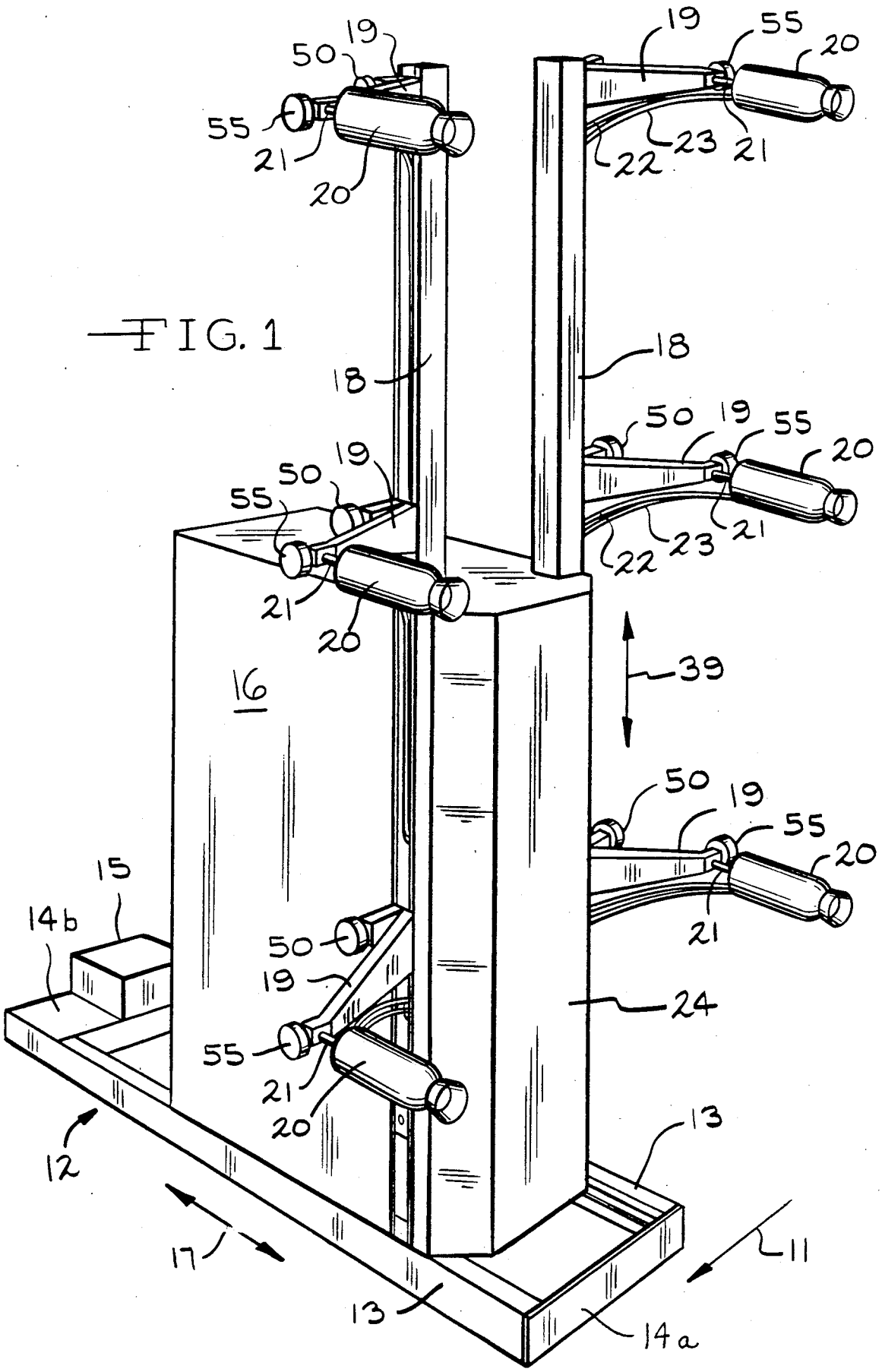
FIG. 1 is a perspective view of a reciprocating device for spray painting according to the present invention.

There is shown in FIG. 1 a reciprocating device according to the present invention for spray painting an object moving past the device. A plurality of objects to be painted or coated are moved along a conveyor (not shown) in the direction of an arrow 11 past the forward or front end of a base member 12 of the reciprocating device. The base member 12 includes a pair of generally parallel spaced apart tracks 13 connected at the front by a cross member 14*a* and at a rear or back end by a cross member 14*b*. An enclosure 15 for a first drive means or driving mechanism is mounted on an upper surface of the rear cross member 14*b*. As will be discussed, the first drive means provides horizontal positioning motion to a second driving mechanism or drive means and frame apparatus mounted in an enclosure 16. The enclosure 16 is slidably mounted along the rails 13 in the direction of an arrow 17 which is generally perpendicular to the direction of movement of the conveyor designated by the arrow 11.

A pair of spaced apart posts 18 extend upwardly in a vertical direction and are attached at opposite front edges of the enclosure 16. The posts 18 function as vertically reciprocable mounting devices for a plurality of spray guns or rotary atomizers. Each of the posts 18 has mounted thereon three mounting arms 19 which extend generally parallel to the direction of travel of the conveyor as designated by the arrow 11. Although three arms are shown, more or less arms could be utilized as required by the size of the object to be coated. A spraying device such as a rotatory atomizer 20 is attached at the outer end of each of the mounting arms 19. Such rotary atomizers are commercially available from the DeVilbiss Company in Toledo, Ohio and are representative of any of a number of spray painting devices which could be utilized.

Each of the rotary atomizers has a mounting rod 21 attached thereto and extending rearwardly into releasable engagement with an outer end of an associated one of the mounting arms 19. In instances wherein electrostatic coating is being performed, the rods 21 are typically formed of an insulating material. Each of the rotary atomizers 20 is also connected to two or more lines 22 and 23. For example, the line 22 can be a fluid line connected to a source of pressurized fluid for operating the rotary atomizer 20 and the line 23 can be a fluid line connected to a source of coating material to be sprayed on an object. Also, an electric line (not shown) can be provided to charge the atomizer 20. The posts 18 are generally hollow and U-shaped in cross section, and the lines 22 and 23 along with other lines (not shown) extend into the central channel formed in the posts and down the channel into the interior of the enclosure 16 where they are connected in a conventional manner through valves and the like to the sources of associated fluid. The posts 18 and the enclosure 16 tend to protect the lines from the damage and overspray problems of the prior art devices.

Figure 2:
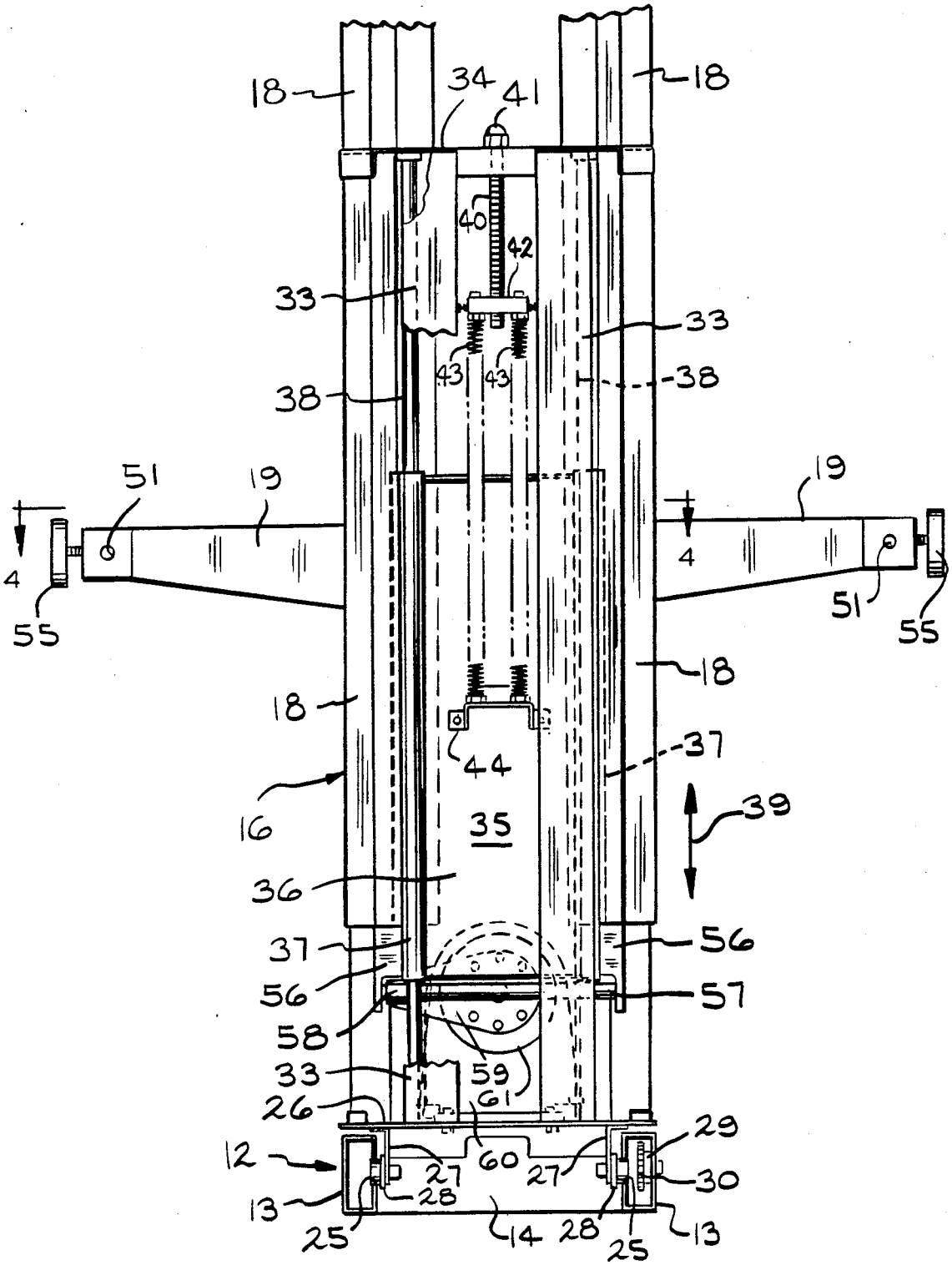
FIG. 2 is a fragmentary front elevational view of the base member of the invention shown in FIG. 1.
Figure 4:
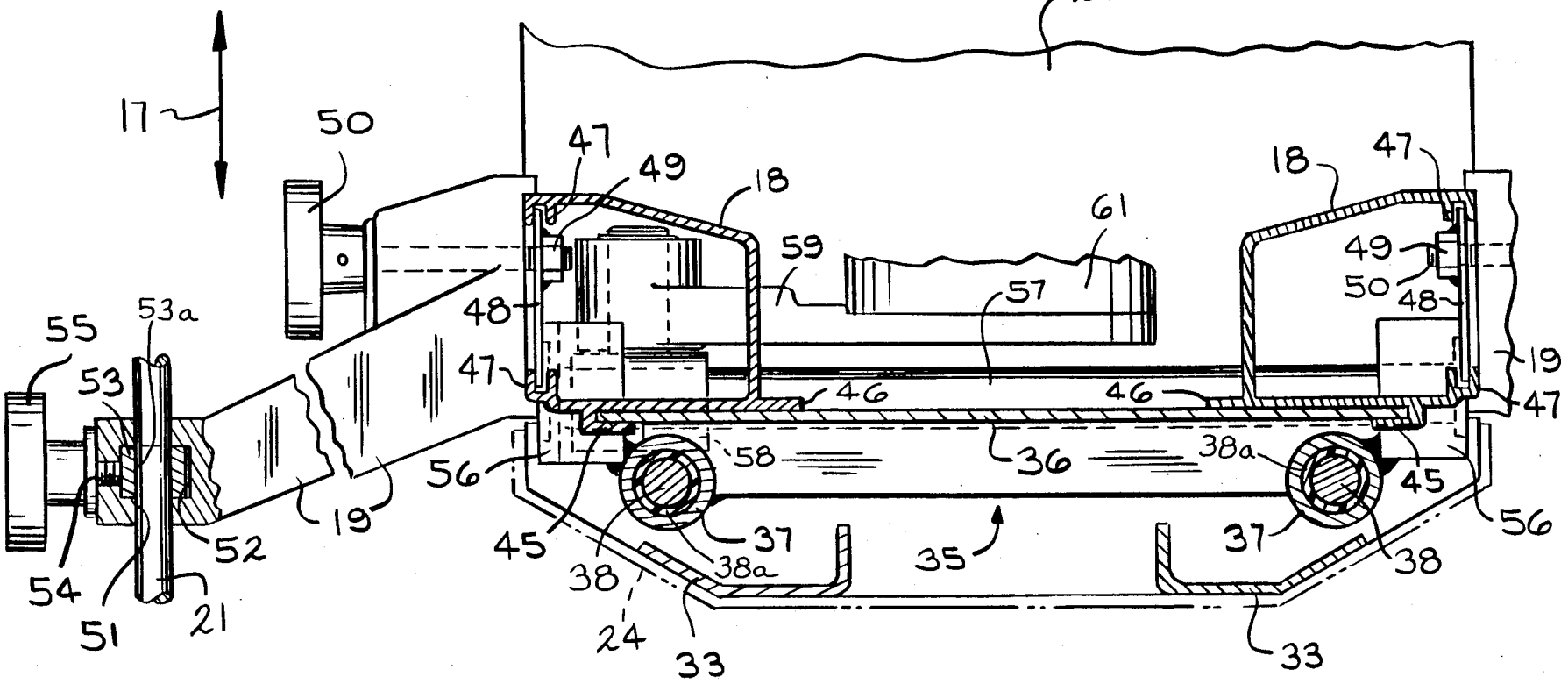
FIG. 4 is a fragmentary, enlarged, cross-sectional view taken along the line 4—4 in FIG. 2.

There is shown in FIG. 2 a fragmentary front elevational view of the base member 12, the enclosure 16, and the posts 18 with their associated mounting elements. FIG. 4 is a fragmentary enlarged cross sectional view taken along the line 4—4 in FIG. 2. Referring to FIGS. 2 and 4, it can be seen that a front cover plate 24 (shown in FIG. 1) has been removed from the enclosure 16 to better show the internal elements and frame. The enclosure 16 is mounted on the rails 13 which have a generally C-shaped cross section with a longitudinally extending slot 25 formed in an inwardly facing wall thereof. The enclosure 16 includes a generally horizontally extending base plate 26. Extending downwardly from a lower surface of the base plate 26 are four brackets 27 each of which has a flanged roller 28 rotatably attached to a lower end thereof. The rollers 28 engage the slots 25 and support the enclosure 16 for horizontal movement along the rails 13 in the direction of the arrow 17 (FIG. 1).

Figure 3:
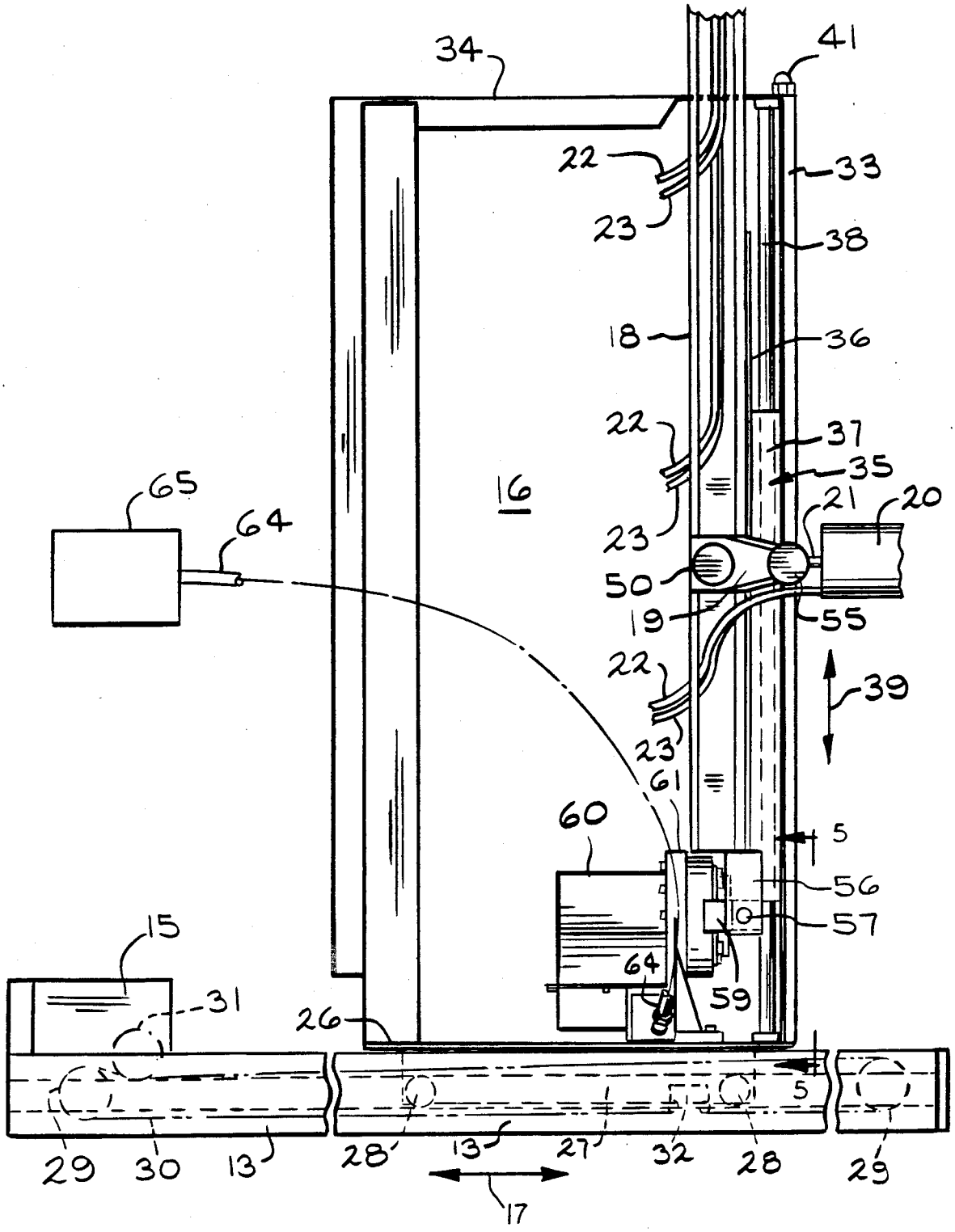
FIG. 3 is a fragmentary left side elevational view of the invention according to FIG. 1.

Referring to FIGS. 2 and 3, the right hand rail 13 (FIG. 2) has a pair of sprockets 29 rotatably mounted inside and at opposite ends thereof. The sprockets 29 are connected by an endless chain 30 which is driven by a toothed drive wheel 31 rotated by a conventional first drive means (not shown) in the drive means enclosure 15. An attachment block 32 extends through the slot 25 and is connected between the chain 30 and the associated one of the mounting brackets 27. Thus, the drive means in the drive means enclosure 15 can be controlled to rotate the chain 30 in either direction thereby moving the enclosure 16 along the rails 13.

Referring to FIGS. 2 through 4, a pair of frame members 33 extend in a vertical direction between the front edges of the base plate 26 and a generally parallel upper cover plate 34 of the enclosure 16. A sled assembly 35 is mounted in the enclosure 16 for vertical reciprocating movement. The sled assembly 35 has a generally planar vertically extending body 36 with a tubular guide 37 attached to each of the vertically extending edges of the body 36. Each of the guides 37 engages one of a pair of guide rods 38 which are spaced apart and extend vertically between the base plate 26 and the cover plate 34. Thus, the sled assembly 35 is free to move in a vertical direction up and down in the direction of the arrow 39 along the guide rods 38. As shown in FIG. 4, the guide rods 38 can be provided with sleeve bearings 38*a* formed of any suitable material such as nylon impregnated glass fiber fabric.

As best shown in FIG. 2, a threaded rod 40 extends through an aperture in the cover plate 34 and has its upper end secured by a nut 41. A lower end of the rod 40 is threadedly engaged in a mounting block 42. A pair of helical coil springs 43 each have one end attached to the mounting block 42 and an opposite end attached to a mounting bracket 44 which is secured to the front face of the sled body 36. The springs 43 are utilized to support all or most of the weight of the sled assembly 35 and the amount of tension applied by the springs 43 can be adjusted by threading the rod 40 into and out of the mounting block 42. Thus, the tension can be adjusted to compensate for the number of arms 19 and rotary atomizers 20 being utilized, for example.

As best shown in FIG. 4, the posts 18 are attached to the sled assembly 35. The posts 18 are generally C-shaped in cross section, with an opening facing outwardly at the sides of the enclosure 16. There is formed on a front surface of each of the posts 18 a generally L-shaped flange 45 which cooperates with the front surface of the post 18 to enclose the vertical peripheral side portions of the planar sled body 36. Although not shown, the flange 45 and the adjacent wall of a post 18 can have apertures formed therein for accepting a bolt and nut assembly which also extends through an aperture formed in the sled body 36 to firmly attach the posts 18 to the sled assembly 35. An additional flange 46 extends from an inwardly facing wall of each of the posts 18 along a rear surface of the sled body 36. Although not shown, the flanges 46 can also have apertures formed therein for accepting a bolt and nut assembly which also extends through apertures formed in the sled body 36 to firmly attach the two elements together.

Each of the posts 18 has a pair of opposed U-shaped flanges 47 formed at the opening thereof. The flanges 47 accept the vertically extending peripheral edges of a mounting plate 48. An inwardly facing surface of the mounting plate 48 has a nut 49 attached thereto. A threaded shaft and handle assembly 50 extends through a body of the arm 19 and through an aperture formed in the mounting plate 48 into threaded engagement with the nut 49. Thus, as the shaft and handle assembly 50 is threaded into engagement with the nut 49, the mounting plate 48 is drawn into engagement with the inner surfaces of the outer legs of the U-shaped flanges 47, and the body of the arm is drawn into engagement with the outer surfaces of such legs to tightly attach the arm 19 to the associated post 18. The shaft and handle assembly 50 can easily be disengaged to allow vertical adjustment of the arms 19 with respect to the posts 18 as desired.

At the outer end of each of the arms 19, there is formed an aperture 51 which extends completely through the arm 19 in a direction parallel to the direction of horizontal movement of the enclosure 16 as represented by the arrow 17. Approximately at the mid point of the aperture 51, there is formed an enlarged cavity 52 of generally circular cross section in which is located a sleeve 53 of slightly smaller diameter than the cavity 52. The sleeve 53 has a central aperture 53*a* formed therein of a diameter sufficient to slidably accept the mounting rod 21 attached to one of the rotary atomizers 20. A threaded aperture 54 is formed in the end of the arm 19 along a longitudinal axis perpendicular to the longitudinal axis of the aperture 51. A threaded shaft and handle assembly 55 threadably engages the aperture 54. As the assembly 55 is threaded into the aperture 54, the inner end of its threaded shaft engages an outer surface of the sleeve 53 and forces the sleeve to the opposite side of the cavity 52, thereby forcing the rod 21 against the sides of the aperture 51 to fix the position of the attached rotary atomizer 20 with respect to the arm 19. Of course, the shaft and handle assembly 55 can be loosened to allow the mounting rod 21 to be repositioned or completely removed from the aperture 51 as shown in FIG. 2.

Figure 5:
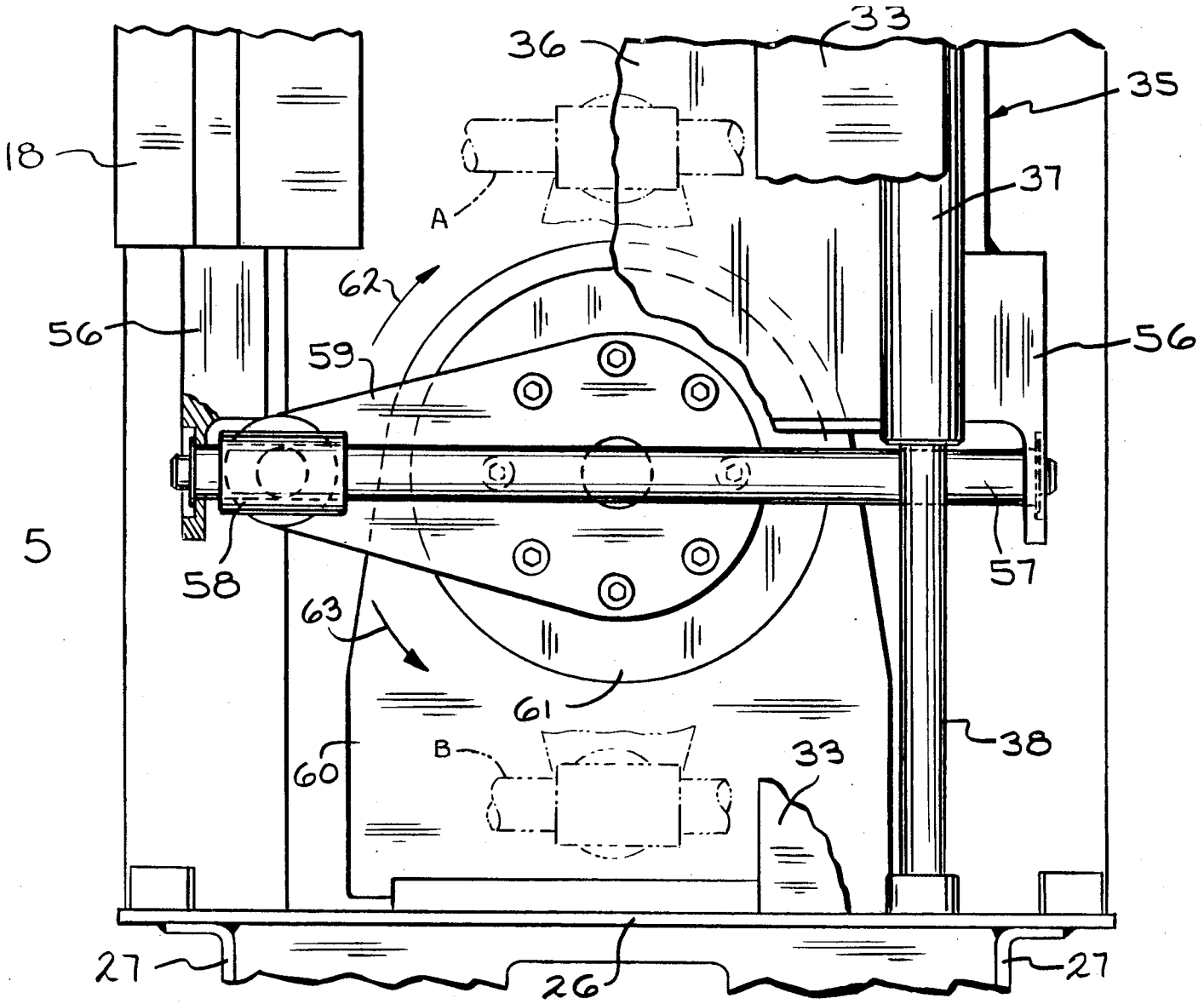
FIG. 5 is a fragmentary, enlarged front elevational view taken along the line 5—5 in FIG. 3.

As best shown in FIG. 5, a mounting bracket 56 is attached at either corner of the lower end of the planar sled body 36. A generally horizontally extending rod 57 has its ends retained by any suitable means in the mounting brackets 56. The rod 57 extends through an aperture formed in a sliding block 58. The block 58 can include a sleeve bearing (not shown) similar to the bearing 38*a*. The block 58 is rotatably attached to one end of a crank arm 59. The other end of the crank arm 59 is attached to an end of a drive shaft of a servomotor 60 through a gear box 61 which provides torque multiplication. The motor 60, gear box 61, crank arm 59, sliding block 58, and rod 57 cooperate to change the rotary motion of the servomotor to reciprocating motion of the sled assembly 35 in the manner of a "scotch yoke" device.

As shown by the arrows 62 and 63, the servomotor can be driven to provide clockwise rotation and counterclockwise rotation respectively to raise and lower the sled assembly 35 respectively. By controlling the degree of the rotation of the servomotor 60, the extent of vertical travel of the sled assembly 35 can be controlled from the mid point shown in FIG. 2 to any excursion up to and including the maximum upper and lower travel distances represented by positions A and B, which are each ninety degrees from the mid point and shown in phantom. Since the speed of the servomotor 60 can also be controlled by well known means, the sled assembly 35 can be moved in a vertical direction under the control of a program which defines the limits of the reciprocating excursions along with the speed of the reciprocating motion. For example, as shown in FIG. 3, the servomotor 60 can be connected by a control cable 64 to a remote control unit 65 which can be any conventional control unit of the type typically utilized to control the direction of rotation, the speed of rotation, and the degree of rotation of a servomotor 60.

Since the crank arm 59 is only rotated through an arc of one hundred eighty degrees or less, the sliding block 58 will move between the position shown in FIG. 5 and a maximum distance represented by one of the two positions A and B shown in phantom. Thus, the rod 57 could be terminated near the point at which the crank arm 59 is rotatably attached to the drive shaft of the servomotor 60. However, if the control unit 65 developed a failure of the type which would allow rotation of the servomotor 60 in only one direction, the present invention could still be operated at the maximum excursion. Furthermore, it should be noted that some servomotors could be directly coupled to the crank arm 59 thereby eliminating the gear box 61.

The reciprocating device for spray painting according to the present invention advantageously provides automatic adjustment of the speed and extent of reciprocal excursion of a spray coating device during the operation of the device. The present invention also does not require any tools to adjust the excursion. Furthermore, means are provided to easily adjust the horizontal distance between the object being sprayed and the spray painting guns or rotary atomizers and also the vertical spacing between multiple spray guns or rotary atomizers.

In accordance with the provisions of the patent statutes, the present invention has been described in what is considered to represent its preferred embodiment. However, it should be noted that the invention can be practice otherwise than as specifically illustrated and described without departing from its spirit or scope.

What is claimed is:

1. A device for reciprocating an apparatus along a linear path comprising:

guide means defining as linear path along which an apparatus is to be reciprocated;

support means for retaining an apparatus, said support means being slidably mounted on said guide means for movement along the linear path;

reversible motor means having a rotatable output shaft;

transmission means coupled to said motor output shaft to reciprocate said support means along said guide means, said transmission means including means for converting rotational movement of said output shaft in one direction to linear movement of said support means in a first linear direction and for converting rotational movement of said output shaft in an opposite direction to linear movement of said support means in a second linear direction opposite said first linear direction; and control means coupled to said motor means for driving said output shaft through a predetermined arc of 180° or less and for altnerately reversing the direction of rotation of said output shaft to cause said support means and the apparatus to alternately travel a predetermined distance in said first and second linear directions along the linear path.

2. The device according to claim 1 wherein said control means includes means for adjusting the amount of rotation of said output shaft in said one direction to control the distance said support means is moved in said first linear direction, and means for adjusting the amount of rotation of said output shaft in said opposite direction to control the distance said support means is moved in said second linear direction.

3. The device according to claim 1 wherein said transmission means includes a crank arm having one end coupled to said motor and an opposite end rotatably coupled to a sliding block, and a rod slidably engaging said sliding block and coupled to said support means whereby when said motor rotates said crank arm, said support means is reciprocated along said linear path.

4. A device for positioning a plurality of spray coating devices with respect to a location at which an object is to be coated comprising:

a plurality of mounting arms each having one end with means for releasably retaining a spray coating device and an opposite end;

at least one generally vertically extending post having means for releasably retaining said opposite ends of said arms, said means for retaining permitting relative vertical positioning of said arms along said post;

means coupled to said post for reciprocating said post along a generally vertical path with respect to a location at which an object is to be coated, said means for reciprocating including a motor coupled to one end of a crank arm having an opposite end rotatably coupled to a sliding block, and a rod slidably engaging said sliding block and coupled to said post whereby when said motor rotates said crank arm, said post is reciprocated along said vertical path; and adjustable control means coupled to said means for reciprocating for selectively determining the excursion of said post and said mounting arms along said vertical path.

5. The device according to claim 4 wherein said spray coating device includes hose means extending therefrom, said post defining a vertically extending channel adapted to receive and retain at least a portion of said hose means.

6. The device according to claim 4 wherein said mounting arm means for releasably retaining includes an aperture formed in said one end of said mounting arm and having an enlarged cavity connected thereto, a sleeve slightly smaller than and enclosed by said cavity, and a threaded rod threadedly engaged in a threaded aperture formed in said mounting arm with one end of said rod extending into said cavity whereby when a mounting rod for a spray coating device is inserted into said aperture and slidably engages said sleeve, said threaded rod is threaded into contact with said sleeve to force said mounting rod into contact with a wall of said aperture.

7. The device according to claim 4 wherein said post means for releasably retaining includes a pair of opposed flanges formed on said post, a mounting plate positioned on one side of said flanges, said opposite end of said mounting arm positioned on an opposite side of said flanges, and a threaded rod rotatably retained by said mounting arm and extending into threaded engagement with said mounting plate whereby when said rod is threaded into said mounting plate said mounting arm and said mounting plate are drawn into contact with said flanges.

8. The device according to claim 4 wherein said means for reciprocating includes a sled assembly coupled between said post and said rod, said sled assembly including a main body coupled between said post and said rod, at least one tubular guide coupled to said main body, and at least one generally vertically extending guide rod slidably engaging said tubular guide for defining said vertical path.

9. The device according to claim 4 wherein said adjustable control means includes means for controlling the direction and degree of rotation of said motor.

10. The device according to claim 9 wherein said adjustable control means includes means for controlling the speed of said motor.

11. A device for positioning a plurality of spray painting devices with respect to a location at which an object is to be painted comprising:

a plurality of mounting arms each having one end with means for selectively and releasably retaining a spray painting device at a selected position along a generally horizontal path with respect to a location at which an object is to be painted;

at least one generally vertically extending post having means for selectively and releasably retaining an opposite end of said arms along a generally vertical path with respect to the location;

adjustable drive means coupled to said post for reciprocating said post and said arms along said generally vertical path within selectively adjustable excursion limits including a motor having an output shaft coupled to one end of a crank arm extending in a generally vertical plane, an opposite end of said crank arm coupled to a sliding block, a rod extending generally horizontally through an aperture in said block for sliding movement relative thereto, said rod being coupled to said post; and control means for selectively controlling the speed, direction of rotation and degree of rotation of said motor.

12. A device for positioning a plurality of spray coating devices with respect to a location at which an object is to be coated comprising:

a pair of spaced apart generally parallel rails defining a generally horizontal path of travel with respect to a location at which an object is to be coated;

a frame mounted for travel on said rails;

first drive means coupled to said frame for selectively positioning said frame along said horizontal path;

a pair of spaced apart generally parallel vertically extending posts mounted on said frame;

a plurality of generally horizontally extending arms for mounting spray coating devices coupled to said posts;

second drive means mounted on said frame and coupled to said posts for reciprocating said posts and said arms in a generally vertical path with respect to the location; and a control unit coupled to said second drive means for selectively determining the excursion of said posts and said arms along said vertical path.

13. The device according to claim 12 wherein said first drive means includes an electric motor coupled to a toothed drive wheel engaging an endless chain mounted on a pair of spaced apart sprockets and said frame is coupled to said chain for movement therewith.

14. The device according to claim 12 wherein each of said arms includes a threaded shaft threadedly engaging a nut attached to a mounting plate and wherein said posts include a pair of opposed generally U-shaped flanges for engaging peripheral edges of said mounting plates whereby when said shaft is threaded into said nut an end of said arm and said plate are drawn together to clamp against opposite sides of a leg of each of said flanges.

15. The device according to claim 12 wherein each of said arms includes an aperture for accepting a rod attached to a spray coating device, each said aperture including an enlarged central cylindrical cavity enclosing a slightly smaller diameter cylindrical sleeve, and each said cavity has an end of a threaded shaft extending therein for engaging said sleeve and forcing said rod against a wall of said aperture.

16. The device according to claim 12 wherein said second drive means includes a motor coupled to one end of a crank arm, a sliding block rotatably coupled to an opposite end of said crank arm, a generally horizontally extending rod slidably engaging an aperture formed in said sliding block and coupled to said posts whereby rotation of said crank arm by said motor in a generally vertical plane reciprocates said rod, said posts and said arms along said vertical path.

17. The device according to claim 16 wherein the distance between said one end and said opposite end of said crank arm determines the maximum excursion of said posts and said arms.

18. The device according to claim 16 wherein said control unit selectively determines the speed of rotation of said crank arm thereby determining the speed and cycle time of reciprocation of said posts and said arms.

19. The device according to claim 16 wherein said control unit selectively determines the direction and degree of rotation of said crank arm thereby determining the excursion of said posts and said arms along said vertical path.

20. The device according to claim 12 wherein said frame includes a main body coupled between said posts and said second drive means, a pair of tubular guides coupled to said body and slidably engaging a pair of spaced apart generally vertically extending rods defining said vertical path of travel whereby said second drive means moves said body and said tubular guides along said rods to reciprocate said posts and said arms.

21. The device according to claim 20 including spring means coupled between said main body and said frame and supporting at least a portion of the weight of said body, said tubular guides, said posts, said arms, and any spray coating devices mounted on said arms.

22. The device according to claim 21 including a threaded rod treadedly engaging a mounting block, said rod and said block coupled between an end of said spring means and said frame for adjusting the tension of said spring means.

23. A device for positioning a plurality of spray coating devices with respect to a location at which an object is to be coated comprising:

a plurality of mounting arms each having one end with means for releasably retaining a spray coating device and an opposite end;

at least one generally vertically extending post having means for releasably retaining said opposite ends of said arms, said means for retaining permitting relative vertical positioning of said arms along said post;

said spray coating device includes hose means extending therefrom, said post defining a vertically extending channel adapted to receive and retain at least a portion of said hose means;

means coupled to said post for reciprocating said post along a generally vertical path with respect to a location at which an object is to be coated; and adjustable control means coupled to said means for reciprocating for selectively determining the excursion of said post and said mounting arms along said vertical path.

24. A device for positioning a plurality of spray coating devices with respect to a location at which an object is to be coated comprising:

a plurality of mounting arms each having one end with means for releasably retaining a spray coating device and an opposite end;

at least one generally vertically extending post having means for releasably retaining said opposite ends of said arms, said means for retaining permitting relative to vertical positioning of said arms along said post, said means for releasably retaining includes a pair of opposed flanged formed on said post, a mounting plate positioned on one side of said flanges, said opposite end of said mounting arm positioned on an opposite side of said flanges, and a threaded rod rotatably retained by said mounting arm and extending into threaded engagement with said mounting plate whereby when said rod is threaded into said mounting plate said mounting arm and said mounting plate are drawn into contact with said flanges;

means coupled to said post for reciprocating said post along a generally vertical path with respect to a location at which an object is to be coated; and adjustable control means coupled to said means for reciprocating for selectively determining the excursion of said post and said mounting arms along said vertical path.

* * * * *